United States Patent [19]

Chikamasa et al.

[11] Patent Number: 4,554,177

[45] Date of Patent: Nov. 19, 1985

[54] DRYING METHOD

[75] Inventors: Hiroshi Chikamasa; Shinji Noda, both of Kanagawa, Japan

[73] Assignee: Fuji Photo Film Co., Ltd., Kanagawa, Japan

[21] Appl. No.: 629,746

[22] Filed: Jul. 11, 1984

Related U.S. Application Data

[63] Continuation of Ser. No. 429,398, Sep. 30, 1982, abandoned.

[30] Foreign Application Priority Data

Oct. 3, 1981 [JP] Japan ..... 56-158035

[51] Int. Cl.[4] ..... B05D 3/02; B05D 3/04; B05D 5/12

[52] U.S. Cl. ..... 427/130; 427/378

[58] Field of Search ..... 427/130, 131, 378

[56] References Cited

U.S. PATENT DOCUMENTS 3,282,725 11/1966 Van Zalinge ..... 427/378 X 4,183,976 1/1980 Yamada et al. ..... 427/378 X

FOREIGN PATENT DOCUMENTS 2550348 5/1977 Fed. Rep. of Germany ..... 427/378

*Primary Examiner*—Michael R. Lusignan

*Attorney, Agent, or Firm*—Sughrue, Mion, Zinn, Macpeak, and Seas

[57] ABSTRACT

A method for drying a running web or belt-like support with an organic solvent-containing coating solution coated thereon is described, comprising introducing the support into a drying room and drying it mainly by hot air blown into the drying room in parallel to the running direction of the support in such a manner that it does not strike directly on the coated surface of the support, while conveying the support in an arch-like or straight form on rolls provided in the drying room. This drying method provides high quality coated-layers and increases producitivity. Further, this method is particularly useful in the preparation of magnetic recording material.

15 Claims, 2 Drawing Figures

DRYING METHOD

This application is a continuation of application Ser. No. 429,398, filed Sept. 30, 1982, now abandoned.

FIELD OF THE INVENTION

The present invention relates to a method for drying materials coated with an organic solvent-containing coating composition. More particularly, it relates to a method for drying web or belt-like supports (hereinafter referred to as "supports") which have been coated with an organic solvent containing coating composition and are run continuously.

BACKGROUND OF THE INVENTION

Organic solvents are usually used in the preparation of magnetic recording materials, photographic light-sensitive materials, heat-sensitive sheets, etc.

Various drying methods have been proposed and are now in practical use for the prevention of pollution, recovery of organic solvents and so forth. For example, there is a method employed for magnetic recording materials in which a continuously running support, e.g., a plastic film, is continuously coated with a coating composition prepared by dispersing magnetic powder, such as ferromagnetic iron oxide, ferromagnetic chromium dioxide, and ferromagnetic alloys, and a binder in an organic solvent. If desired, the magnetic recording material may be subjected to various treatments such as magnetic field orientation. Thereafter, the coated support is sent to a drying room where it is continuously dried by blowing hot air thereonto while conveying it in an arch-like or straight form on a number of rolls provided in the drying room.

The various drying methods can be divided into two groups—i.e., a horizontal flow drying method and a vertical flow drying method. In accordance with the horizontal flow drying method, a coated support is conveyed in a drying room at a proper speed (as described hereinafter) and hot air is blown onto the coated surface of the support horizontally relative to the coated surface in either the same direction as or the opposite direction to the direction of the movement of the support. On the other hand, in the vertical flow drying method, hot air is blown vertically onto the coated surface of the support through holes or slits provided above a support-conveying unit in the drying room.

In each drying method, the solvent is vaporized during the drying procedure and thus there is the danger of an explosion when the gas concentration in the drying room reaches a certain level. It is therefore necessary to maintain the gas concentration below the lower critical limit of the solvent gas explosion concentration—e.g., about 25 to 33% to prevent an explosion. Hence, it is preferrable to feed a larger amount of air to maintain the gas concentration below the critical limit.

In accordance with the horizontal flow drying method, a good coated-surface can be obtained only when hot air is blown onto the support uniformly over the entire width of the support since, as described above, the hot air is blown directly onto the coated surface in either the same direction as or the opposite direction to the direction of the movement of the support.

In the early stages of the drying procedure, the coated surface still possesses fluidity. Thus, the coated surface is readily influenced by conditions such as the air-blowing speed. When the air-blowing speed is increased, the support beings to flutter and it becomes impossible to keep the support in a stable running condition.

In the vertical flow drying method, it is also necessary for the gas concentration to be maintained at a level below the lower critical limit of solvent gas explosion concentration (25 to 33%) for the sake of safety as previously described for the horizontal flow drying method. Further, it is desirable to increase the amount of air-feed (air-blowing speed). However, such an increase in the amount of air-feed leads to rapid solvent vaporization.

On the other hand, in order to obtain a uniform coated-surface, it is preferable to lower the solvent vaporization speed and to decrease the air-blowing speed since this reduces the influences caused by air-blowing, e.g., fluttering of the web. Hence, it is difficult to satisfy the two requirements of maintaining a low level of solvent gas concentration and a low solvent vaporization speed at the same time.

In accordance with conventional methods, it is difficult to produce a good coated-layer and increase productivity under safe conditions i.e., while preventing an explosion. The reasons for this are explained in detail below.

The temperature of dry hot air is usually from 50° to 120° C. (the boiling point of the primary solvent used is 130° C. or lower). Within this temperature range, it is suitable for the speed of air to be blown onto the coated layer—i.e., the air-blowing speed, to be maintained within the range of from 1 to 5 m/sec (the maximum value: 10 m/sec). Further, it is required that the support-conveying speed be at least 40 m/min and the drying time be from 5 to 20 seconds. However, when the support-conveying speed is increased to, for example, 60 to 120 m/min (1 to 2 m/sec) or more in order to increase productivity, the amount of vaporization of the solvent increases. Therefore, if drying is performed without increasing the dry hot air-blowing speed (i.e., amount of dry hot air-feed), the solvent gas concentration increases. Hence, in performing drying by conventional methods, it is necessary to increase the hot air-blowing speed (i.e., amount of hot air-feed) to prevent an explosion. This makes it difficult to maintain the drying conditions required for producing a good coated-layer.

SUMMARY OF THE INVENTION

An object of the present invention is to provide a method of drying a web-like support coated with an organic solvent-containing coating solution which is free from any danger of explosion due to an increased solvent gas concentration wherein the support is run at a speed of at least 60 m/min and wherein the method enables on to obtain a good coated-layer.

The present invention relates to a drying method which comprises coating an organic solvent-containing coating solution on a running web-like support and sending the coated support into a drying room where the coated support is dried by blowing hot air thereonto while conveying it in an arch-like or straight form on rolls provided in the drying room, wherein the coated support is dried mainly by the hot air which is blown parallel to the running direction of the support and in such a manner that it does not strike directly on the coated support.

DETAILED DESCRIPTION OF THE INVENTION

The drying method of the present invention is charactized in that a running support with an organic solvent-containing coating solution coated thereon is dried mainly by hot air which is blown from air-blowing openings designed to be broader than the width of the support and disposed of along the running direction of the support in such a manner that it does not strike directly on the support.

Figure 1:
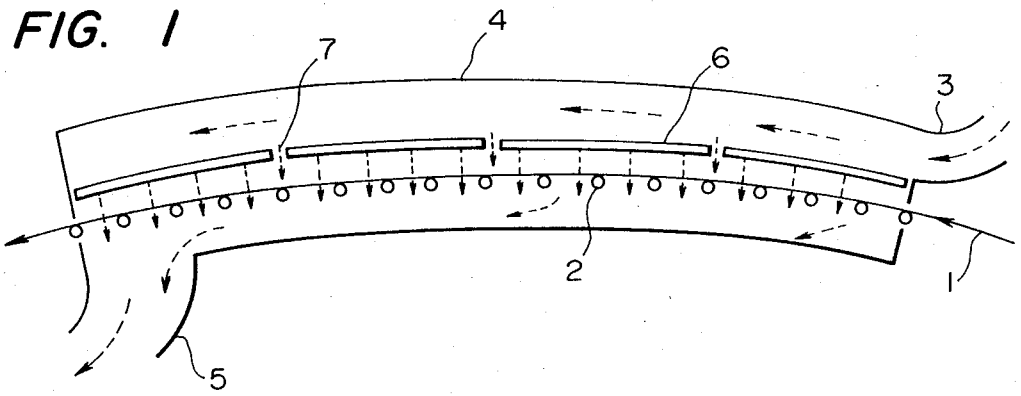
FIG. 1 is a longitudinal sectional view schematically illustrating an embodiment of the drying method of the present invention.
Figure 2:
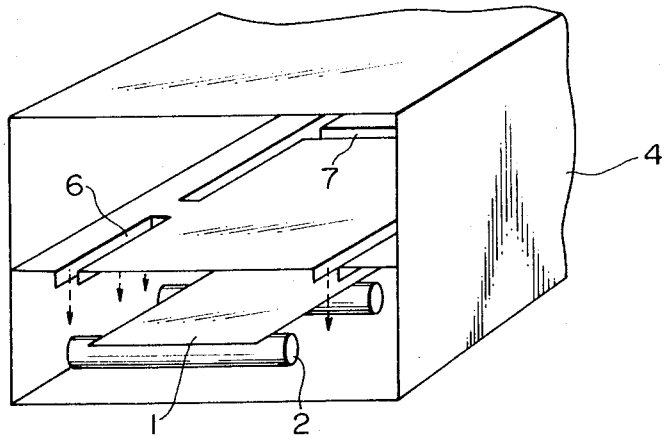
FIG. 2 is a schematic perspective view illustrating an embodiment of the drying method of the present invention.

The drying method of the present invention will hereinafter be explained with reference to the accompanying drawings wherein FIG. 1 illustrates an embodiment of the drying method of the invention, and FIG. 2 is a perspective view showing the cross-section of the embodiment of FIG. 1.

Referring to FIG. 1, support 1 with an organic solvent-containing coating solution coated thereon is introduced into a drying room 4 and moves on rolls 2 at a constant speed.

Primary organic solvents which are used in the preparation of such coating solutions have a boiling point of 130° C. or lower. Examples include acetone, methyl ethyl ketone, methyl isobutyl ketone, toluene, tetrahydrofuran, methyl cellosolve, butyl acetate, ethyl acetate, methylene chloride, and ethylene chloride. The solvents can be used alone or in combination with each other. In addition, as sub-organic solvents having a boiling point of 130° C. or higher—e.g., cyclohexanone—can be used.

The drying method of the present invention is suitable particularly for use in the production of magnetic recording materials—i.e., it is particularly suitable for drying materials coated with an organic solvent dispersion containing magnetic powder as described above and a plastic binder.

In the practice of drying, hot air is supplied from air-supplying duct 3. The thus-supplied air is blown out from slits or holes 6 provided in the frying room onto both sides of the support and is then discharged out of the system through discharging duct 5 along with the solvent gas which has vaporized from the coated layer. When the support-conveying speed is set at 60 to 120 m/min or more, it is nearly equal to an air-blowing out speed of 1 to 5 m/sec (the maximum speed: 10 m/sec). This permits the production of a uniformly dried coated surface. Furthermore, since the solvent gas which has vaporized from the coated surface is discharged by the supplied air, it is possible to maintain the solvent gas concentration below the critical limit of explosion. Moreover, since the hot air is not blown directly on the support, the fluttering of the support does not occur. This effect is very significant particularly in the early stages of drying because the coated layer still possesses fluidity.

The drying method of the present invention enables one to obtain a coated layer of high quality compared with the conventional methods while increasing productivity thereof.

Also, it is possible to provide slits or holes 7 orthogonal to the slits 6 so as not to exert a bad influence on the coated layer. That is, near the air-supplying duct 3, slits or holes 7 are provided with a long distance to each other, while slits or holes 7 are provided with short distance to each other near the discharging duct 5.

Although, in the above-described embodiment, air blowing openings are provided above the web-like support, such air blowing openings may also be provided below the web-like support.

Furthermore, it is possible to employ the drying method of the present invention in combination with conventional drying methods depending on the type of solvent employed and differences in the drying conditions.

While the invention has been described in detail and with reference to specific embodiments thereof, it will be apparent to one skilled in the art that various changes and modifications can be made therein without departing from the spirit and scope thereof.

What is claimed is:

1. A method for drying a running web or belt-like support with an organic solvent-containing coating solution coated thereon for the preparation of a magnetic recording material, comprising the steps of; introducing the support into a drying room, drying said support by hot air introduced into the drying room parallel to the running direction of the support in such a manner that said hot air does not strike directly on the coated surface of the support, and continuously conveying the support in an arch-like or straight form through said drying room on rolls provided therein.

2. A method for drying a running web or belt-like support with an organic solvent-containing coating solution thereon as claimed in claim 1, wherein the hot air is blown through air-blowing openings designed to be broader than the width of the support and the hot air is disposed of along the running direction of the support so as to bring about vaporization of the solvent.

3. A method for drying a running web or belt-like support with an organic solvent-containing coating solution thereon as claimed in claim 1, wherein the organic solvent is a primary solvent have a boiling point of 130° C. or lower.

4. A method for drying a running web or belt-like support with an organic solvent-containing coating solution thereon as claimed in claim 1, wherein the web-conveying speed is at least 60 m/min.

5. The method for drying a running web or belt-like support with an organic solvent-containing coating solution thereon as claimed in claim 1, wherein the air blown into the drying room is blown in at a speed of 10 m/sec.

6. A method for drying a running web or belt-like support with an organic solvent-containing coating solution thereon as in claim 3, wherein the organic solvent is at least one member selected from the group consisting of acetone, methyl ethyl ketone, methyl isobutyl ketone, toluene, tetrahydrofuran, methyl cellosolve, butyl acetate, ethyl acetate, methylene chloride and ethylene chloride.

7. A method for drying a running web or belt-like support with an organic solvent-containing coating solution thereon as claimed in claim 1, wherein the organic solvent is a sub-solvent having a boiling point of 130° C. or higher.

8. A method for drying a running web or belt-like support with an organic solvent-containing coating solution thereon as claimed in claim 7, wherein the sub-solvent is cyclohexanone.

9. A method for drying a running web or belt-like support with an organic solvent-containing coating solution thereon as claimed in claim 1, wherein the coating solution comprises a magnetic powder and a plastic binder.

10. The method for drying a running web or belt-like support with an organic solvent-containing coating solution thereon as claimed in claim 9, wherein the magnetic powder is selected from the group consisting of ferromagnetic iron oxide, ferromagnetic chromium dioxide and ferromagnetic alloys.

11. The method for drying a running web or belt-like support with an organic solvent-containing coating solution thereon as claimed in claim 1, wherein the air blown into the drying room is blown in at a speed of 1–5 m/sec.

12. The method for drying a running web or belt-like support with an organic solvent-containing coating solution thereon as claimed in claim 2, wherein the air-blowing openings are above the support.

13. The method for drying a running web or belt-like support with an organic solvent-containing coating solution thereon as claimed in claim 2, wherein the air-blowing openings are below the support.

14. A method for drying a running or belt-like support with an organic solvent-containing coating solution coated thereon, comprising the steps of; introducing the support into a drying room, introducing hot air into the drying room in a direction parallel to the running direction of the support in such a manner that said hot air does not strike directly on the coated surface of the support, continuously conveying the support in an arch-like or straight form through said drying room on rolls provided therein, drying said support while it passes through said drying room and continuously discharging said hot air from said drying room by air flow around said support.

15. A method for drying a running web or belt-like support with an organic solvent-containing coating solution coated thereon, comprising the steps of; introducing the support into a drying room, drying said support by hot air introduced into the drying room parallel to the running direction of the support, said hot air moving in such a manner that it does not strike directly on the coated surface of the support by moving parallel to said support and separated therefrom and discharged along the side of said support, and continuously conveying the support in an arch-like or straight form through said drying room on rolls provided therein.

* * * * *